United States Patent [19]

Johns

[11] 4,301,458

[45] Nov. 17, 1981

[54] ANTENNA ARRAY WITH IMPEDANCE MATCHING USING MUTUAL COUPLING

[75] Inventor: McKinley R. Johns, Cherry Hill, N.J.

[73] Assignee: RCA Corporation, New York, N.Y.

[21] Appl. No.: 125,635

[22] Filed: Feb. 28, 1980

[51] Int. Cl.[3] ..... H01Q 21/24

[52] U.S. Cl. ..... 343/800; 343/822; 343/890

[58] Field of Search ..... 343/725, 726, 727, 728, 343/800, 890, 820, 821, 822

[56] References Cited

U.S. PATENT DOCUMENTS 2,426,632 9/1947 Marchand ..... 343/726

4,031,536 6/1977 Alford ..... 343/796

*Primary Examiner*—Eli Lieberman

*Attorney, Agent, or Firm*—Paul J. Rasmussen; William H. Meise; Henry I. Steckler

[57] ABSTRACT

A circularly polarized antenna has bays stacked at spacings of less than one wavelength in order to have a broadband SWR characteristic and to minimize radiation along a supporting mast axis. Vertical stubs are used to increase the circularity of the horizontal pattern and to improve the axial ratio.

4 Claims, 6 Drawing Figures

ANTENNA ARRAY WITH IMPEDANCE MATCHING USING MUTUAL COUPLING

BACKGROUND OF THE INVENTION

The present invention relates to broadband impedance matching, and more particularly for such impedance matching for use with circularly polarized (CP) antennas.

The standing wave ratio (SWR) requirements for a television transmitting antenna are very stringent. In particular, it is desired that the SWR not exceed 1.1:1 across a given television channel. When stacking bays of one particular CP antenna, it has been found that one wavelength spacing provides maximum gain, as shown in FIG. 8 of U.S. Pat. No. 4,031,536. However, for one embodiment of a slanted dipole type of array having multiple bays, this spacing makes the SWR versus frequency characteristic narrower in bandwidth and makes for greater radiation along the mast axis.

It is desirable to have an antenna with a broadband SWR characteristic which also decreases radiation along the mast axis.

SUMMARY OF THE INVENTION

An antenna array comprising a plurality of stacked bays, each bay comprising a plurality of antennas, each antenna comprising a dipole and a pair of stubs electrically coupled to said dipole, and means for broadbanding said array comprising the spacing between the top and bottom bays and the respective adjacent bays being about 0.76 of a wavelength, any remaining spacings between bays being about 0.82 of a wavelength.

DETAILED DESCRIPTION

Figure 1:
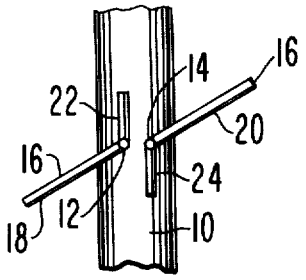
FIG. 1 shows a single antenna.

FIG. 1 shows a portion of a conducting vertical mast 10 having horizontally projecting tubes 12 and 14 mounted thereon. Mounted on these tubes is a dipole 16 having sections 18 and 20, each section being about one quarter wavelength long at the center of a desired channel. The dipole 16 is slanted at an angle of about 35°, in order to give both horizontal and vertical radiation. Since the mast 10 is conducting, it tends to interfere with the vertical radiation pattern from the antenna. In order to improve the circularity of the horizontal radiation pattern of the vertical component of the electric field radiated by antenna 16, as well as the axial ratio, stubs 22 and 24 are provided, which are electrically coupled to the dipole sections 18 and 20 respectively. These stubs 22 and 24 are each about 0.15 wavelengths long.

Figure 2:
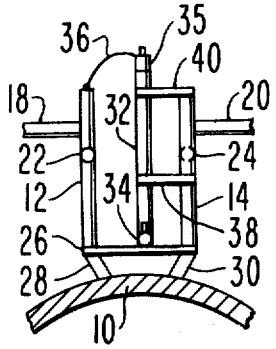
FIG. 2 shows a method of feeding the antenna.

FIG. 2 shows a method of feeding the dipole 16 and the stubs 22 and 24. The pipes 12 and 14 are each about one quarter wavelength long and mounted on a conducting plate 26, which in turn is mounted to the mast 10 by way of supports 28 and 30. The dipole elements 18 and 20 and the stubs 22 and 24 are not mounted at the ends of the pipes 12 and 14, but are set back from the outer ends thereof by approximately one quarter of the length of pipes 12 and 14 to improve the circularity of the horizontal pattern of the vertical component of the electric field, which makes the horizontal patterns of both horizontal and vertical components more nearly the same, thus improving the axial ratio by making it more nearly equal to one. The dipole elements 18 and 20 are set about 0.02 wavelengths in front of the stubs 22 and 24 to reduce the radiation resistance, thus making impedance matching easier. Another pipe 32 has an inner conductor extending throughout its length (not shown), thus forming a coaxial cable. Pipe 32 is mounted on plate 26 and has at its bottom a T section 34. The part of the T section 34 that is above the plane of FIG. 2 receives a feeder coaxial cable (not shown) and the part of the T section 34 that is below the plane of FIG. 2 receives an impedance matching stub (not shown). The feeder coaxial cable has an inner conductor coupled to an inner conductor of T section 34, that in turn is connected to the inner conductor of pipe 32. The inner conductor of pipe 32 extends through an insulator 35 and to a strap 36 that is connected to pipe 22. The outer conductor of said feeder coaxial cable is connected to the outer shell of T section 34 and hence to the outer shell of pipe 32. Pipe 32 is electrically and mechanically connected to pipe 14 by straps 38 and 40. It will be seen therefore that a balun is formed by the pipes 12, 32 and 14.

Figure 3:
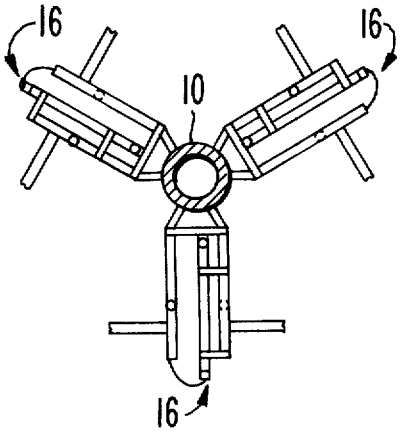
FIG. 3 shows several antennas arranged to form one bay.

FIG. 3 shows how in a particular embodiment three of the dipoles 16 are disposed at 120° angles with respect to each other around the mast 10 to form a single bay. Other embodiments can have other numbers of antennas disposed about mast 10 to form a bay.

Figure 4:
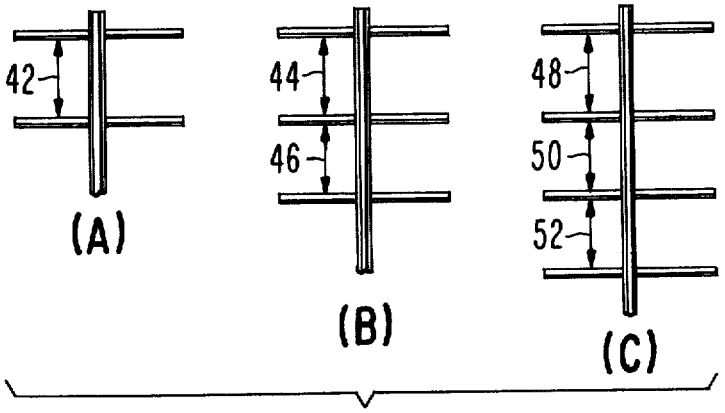
FIGS. 4A, B, and C show stacking arrangements of the bays of FIG. 3.

FIG. 4 shows various stacking arrangements of the bays such as shown in FIG. 3 without showing the details of the bays themselves. In FIG. 4A, two bays are stacked, and it has been found that instead of using the conventional one wavelength spacing, a spacing 42 of about 0.76 of a wavelength provides a broadband SWR characteristic due to the mutual impedance between the arrays. It also decreases radiation along the mast axis as compared to using one wavelength spacing. FIG. 4B shows three bays stacked with spacings 44 and 46 therebetween. If these spacings are made 0.76 of a wavelength, a broadband SWR curve is achieved. FIG. 4C shows four bays with spacings 48, 50 and 52 therebetween. It has been found that the end spacings 48 and 52 should be about 0.76 wavelengths, while the spacing 50 should be about 0.82 of a wavelength. This is because the two inner bays are interreacting with the end bays as well as each other, whereas the end bays do not have two adjacent bays, and therefore must be spaced closer to their one adjacent bay for the same degree of broadbandedness. Obviously further bays can be stacked to produce still higher gain arrays. In this case, the end spacings would be 0.76 of a wavelength, while the remaining inner spacings would be 0.82 of a wavelength. It has been found with the spacing as shown in any of FIGS. 4A, B, or C eleven percent bandwidth is possible with an SWR of less than 1.1 to 1 across a television channel, whereas previously using one wavelength spacing this bandwidth could not be achieved. In a particular embodiment using seven bays, nearly the same vertical pattern and windloading was achieved as a horizontal polarized six bay "Superturnstile" antenna. This allowed direct replacement of the horizontally polarized antenna on existing towers.

In all of the above embodiments individual feed lines for each antenna are provided and brought to a junction box (not shown) where all lines are fed in phase from a main transmission line.

What is claimed is:

1. An antenna array comprising a plurality of vertically stacked bays, each bay comprising a plurality of antennas, each antenna comprising a slanted dipole and a pair of vertical stubs electrically coupled to said dipole, and means for broadbanding said array comprising the spacing between the top and bottom bays and the respective adjacent bays being about 0.76 of a wavelength, any remaining spacings between bays being about 0.82 of a wavelength.

2. An array as claimed in claim 1, further comprising a conducting mast, and means for supporting said antennas horizontally spaced from said mast, said stubs being about 0.02 wavelengths closer to said mast than said dipole.

3. An antenna as claimed in claim 2, wherein said support means comprises a one quarter wavelength stub.

4. An antenna array comprising at least four stacked bays, each bay comprising a plurality of antennas, each antenna comprising a dipole and a pair of stubs electrically coupled to said dipole, and means for broadbanding said array comprising the spacing between the top and bottom bays and the respective adjacent bays being about 0.76 of a wavelength, the remaining spacings between bays being about 0.82 of a wavelength.

* * * * *